US007377521B2

(12) United States Patent
Burg

(10) Patent No.: US 7,377,521 B2
(45) Date of Patent: May 27, 2008

(54) PROCESS FOR FABRICATING A METALLIC SHEET WITH AT LEAST ONE INTEGRATED RAISED SURFACE ZONE FOR A COMPRESSED METALLIC GASKET, PARTICULARLY A CYLINDER HEAD GASKET, AND SHEET THUS OBTAINED

(75) Inventor: Jean-Pascal Burg, Saint Gence (FR)

(73) Assignee: Carl Freudenberg KG (DE)

( * ) Notice: Subject to any disclaimer, the term of this patent is extended or adjusted under 35 U.S.C. 154(b) by 155 days.

(21) Appl. No.: 11/221,413

(22) Filed: Sep. 7, 2005

(65) Prior Publication Data

US 2006/0207081 A1 Sep. 21, 2006

(30) Foreign Application Priority Data

Sep. 21, 2004 (FR) ..... 04 52117

(51) Int. Cl.
*F02F 11/00* (2006.01)
*B21D 31/02* (2006.01)

(52) U.S. Cl. ..... 277/598; 72/325; 72/335

(58) Field of Classification Search ..... 277/591, 277/593, 594, 598; 72/325, 335, 379.2
See application file for complete search history.

(56) References Cited

U.S. PATENT DOCUMENTS

| | | | | |
|---|---|---|---|---|
| 1,771,596 | A * | 7/1930 | Victor | 277/598 |
| 3,738,558 | A * | 6/1973 | Colwell | 277/592 |
| 5,368,316 | A * | 11/1994 | Miyaoh | 277/591 |
| 5,979,905 | A * | 11/1999 | Fischer et al. | 277/591 |
| 7,059,610 | B2 * | 6/2006 | Hegmann | 277/598 |
| 2003/0197334 | A1 * | 10/2003 | Werz et al. | 277/593 |

* cited by examiner

*Primary Examiner*—Patricia Engle
*Assistant Examiner*—Gilbert Y Lee
(74) *Attorney, Agent, or Firm*—Harness, Dickey & Pierce, P.L.C.

(57) ABSTRACT

A process for fabricating a metallic sheet containing at least one raised surface zone. The process including the steps of making at least one cutout (20) in said metallic sheet (10) to obtain at least one flap (22), subjecting the said at least one flap (22) to deformation with bending and extension so as to form an overlap, and flattening and calibrating the protruding height of said at least one flap (22) to form a raised surface zone (24) of adjusted.

4 Claims, 2 Drawing Sheets

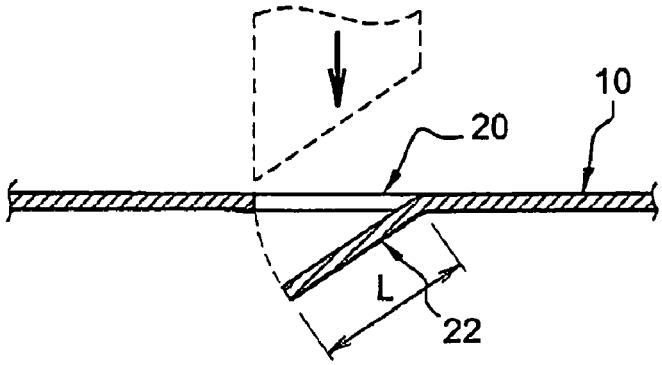
Fig. 2A
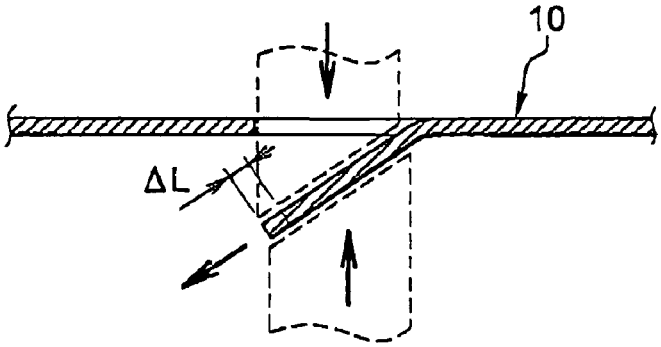
Fig. 2B
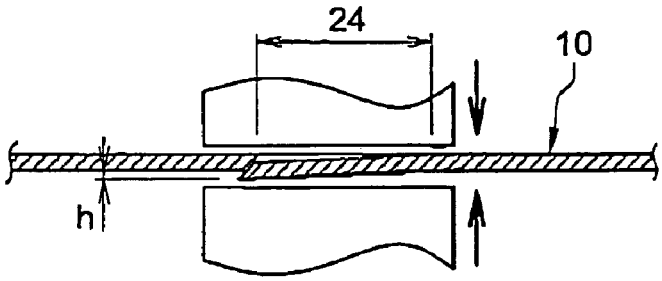
Fig. 2C
Fig. 3
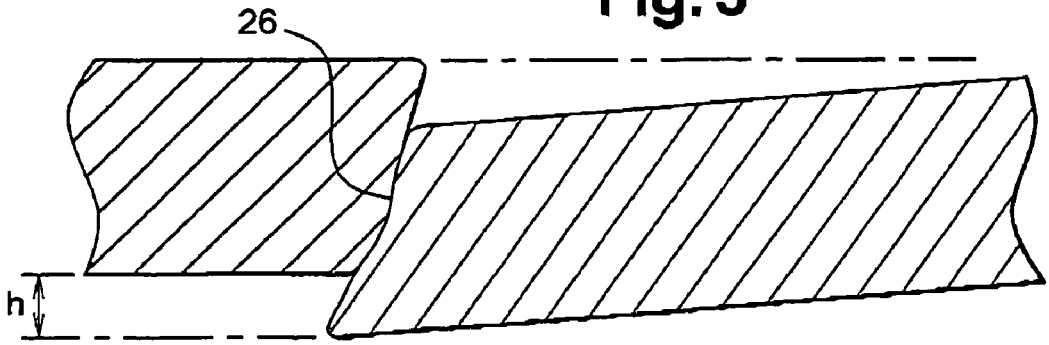

PROCESS FOR FABRICATING A METALLIC SHEET WITH AT LEAST ONE INTEGRATED RAISED SURFACE ZONE FOR A COMPRESSED METALLIC GASKET, PARTICULARLY A CYLINDER HEAD GASKET, AND SHEET THUS OBTAINED

CROSS-REFERENCE TO RELATED APPLICATIONS

This application claims the benefit of French Patent Application 04 52117, filed Sep. 21, 2004. The disclosure of the above application is incorporated herein by reference.

FIELD OF THE INVENTION

The present invention relates to a process for fabricating a metallic sheet with at least one integrated raised surface zone for a compressed metallic gasket such as a cylinder head gasket, and to a gasket including at least one metallic sheet provided with at least one raised surface zone that makes it possible to create a gasket.

BACKGROUND OF THE INVENTION

It is known that in the case of compressed metallic gaskets such as cylinder head gaskets, particularly in the case of the sheet of a single-sheet gasket or one of the active sheets of a multi-sheet gasket, the stress zones are located around the tightening points.

These zones are thus relatively concentrated and cause differences in the distribution of applied pressures. As such, possible tightness differences occur in certain zones.

One solution to this problem consists of increasing the tightening pressures. Such a solution, however, is generally not satisfactory because the difference in pressures subsists. Moreover, an increase in tightening pressures requires a resizing of the parts which is contrary to the goals generally pursued by the automobile industry, at least in terms of light weight.

Thus, to re-establish a distribution equilibrium, it is known to use stops. These stops pick up the stresses in certain distinct zones of tightening points to homogenize the charting or tightening pressures.

Although many approaches have been proposed to create these stops, they are not all satisfactory, particularly from the cost perspective. In fact, gaskets equipped with such stops must give convincing results in terms of equilibrium distributions of tightening stresses, and must be capable of being fabricated rapidly, inexpensively, and with satisfactory reproducibility.

It is also known in the industry that the recovery of parts for complementary fabrication steps is highly penalizing from the standpoint of management, and particularly because it causes major cost increases.

SUMMARY OF THE INVENTION

In view of the above drawbacks, an object of the present invention is to obtain stops directly and continuously on the fabrication line for a single-sheet gasket or one of the sheets of a multi-sheet gasket.

Another object is to obtain on the same sheet or the same plate, stops of different thicknesses depending on the zone to obtain a charting of pressures, and not only of distribution points. In this case, the stops are mostly on the surface and, hence, will in the following be referred to by the term "raised surface zone."

Another objective of the invention is to be able to obtain, after tightening, the desired pressure charting and thus to provide raised surface zones appropriately distributed to obtain this charting. To obtain such a distribution, it is necessary to have multiple raised surface zones, which explains the interest in simple fabrication such as that based on the present invention.

The fact that the pressure stresses can be better distributed also results in less deformation of the parts that compress the gasket on both sides. As a result, it is possible to reduce the dimensions of these parts or their complexity needed to respond to such deformations.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

This description will be made by reference to the attached sets of drawings of which:

FIGS. 2A, 2B, and 2C show views of steps in the fabrication of raised surface zones of the invention for a sealing gasket such as that of FIG. 1;

FIG. 3 shows a greatly enlarged detailed view of a raised surface zone; and

DETAILED DESCRIPTION OF THE PREFERRED EMBODIMENTS

The following description of the preferred embodiment(s) is merely exemplary in nature and is in no way intended to limit the invention, its application, or uses.

Figure 1:
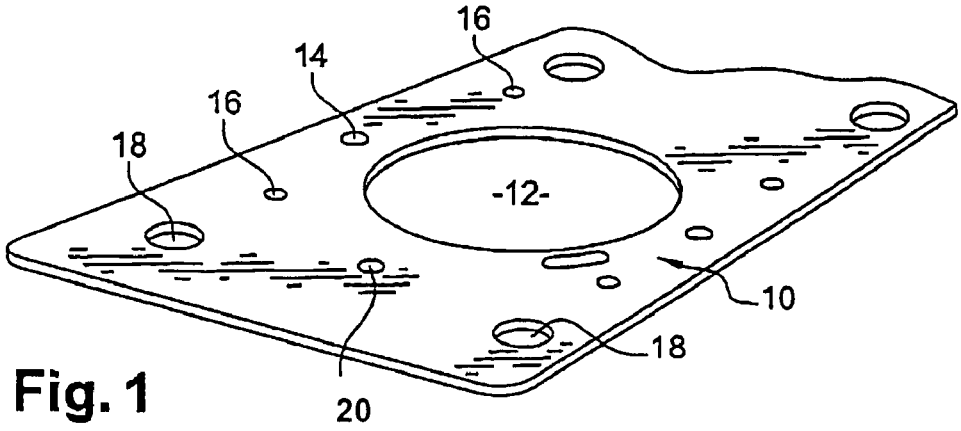
FIG. 1 shows a view of a sheet of a metallic sealing gasket according to a principle of the present invention.
Figure 4A:
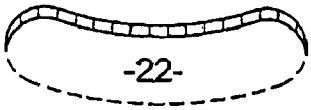
FIGS. 4A to 4F show a view of different cutout profiles for obtaining the raised surface zones of the invention.
Figure 4B:
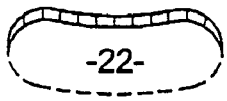
Figure 4C:
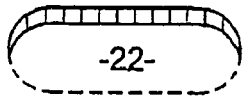
Figure 4D:
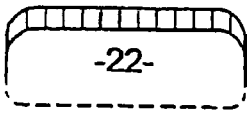
Figure 4E:
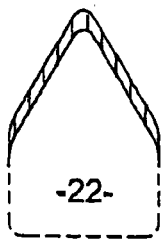
Figure 4F:
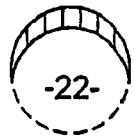

FIG. 1 shows a sheet 10 of a single-sheet gasket, or one of the active sheets in the case of a multi-sheet gasket. In the following description, the term "sheet" will be used to refer indifferently to a metallic sheet of a single-sheet gasket or to one of the sheets in the case of a multi-sheet gasket, particularly the intermediate sheet, generally made of a more malleable carbon steel.

For application to a cylinder head gasket, the sheet 10 preferably has a thickness of, for example, 0.01 to 1.0 millimeters.

Also in the following description, it should be understood that although a cylinder head gasket is mentioned as an example of the present invention, the present invention can be used in applications that extend to gaskets for exhaust lines, gaskets for receivers, or more generally to peripheral gaskets.

Sheet 10 generally comprises central cutouts 12 that correspond to cylinders and holes 14 and 16, respectively, for the passage of water and oil. Also provided are passages 18 for bolts that are used to tighten two parts, namely in the case of a cylinder head gasket, the engine block and the cylinder head.

The process of the present invention consists of forming at least one cutout 20 in the sheet 10 to obtain a flap 22. The cutout 20 is a partial cutout to allow the resulting flap 22 to bend along a line that is not cut. The cutout 20 and bent flap 22 are shown in FIG. 2A. It has a length L and a profile coupled to that of the cutout 20.

A second step of fabrication of the raised surface zone of the invention consists of extending the flap 22. The extension of the flap 20 can be accomplished, for example, by forging. This extension ΔL remains limited and is preferably made at a free end of the flap 22.

A third step consists of flattening and simultaneously calibrating a protruding height of the flap 22 to obtain an adjusted raised surface zone 24. Calibration is achieved by pressing the flap 22 so that it tends to retake its place in the cutout 20 from which it was formed.

Because of the extension ΔL, a reintegration of the flap 22 into the cutout 20 is not possible. Such an action leads to an overlap with superposition of the end of flap 22 on the edge of the cutout 20 forming an extra height h which, during mounting, constitutes the desired raised surface zone 24. The flattening and calibration stresses make it possible to obtain the desired height.

For the sheet 10 to be used as an element of a gasket, the calibration stresses must be lower than the subsequent tightening stresses on the sheet 10. In this manner, the resulting raised surface zone 24 will be resistant to crushing stresses.

This raised surface zone 24 is shown in detail in FIG. 3. Under the calibration stresses, the edges of the cutout 20 and the end of the flap 22 yield and undergo a deformation to form an essentially tapered interface 26.

To give an order of magnitude, the cutouts 20 and the flaps 22 derived therefrom have dimensions of about 0.5 to 5 millimeters.

It should be understood that calibration and flattening tools can have profiles that are not flat, which can generate different calibrations that results in raised surface zones having different heights h. These height variations make it possible to generate a surface charting and not just a point charting.

The distribution of pressures is very gradual and almost continues over the entire surface without generating points of constraint.

The density of the raised surface zones 24, their dimensions, height, and localization on the surface allow very fine regulation of the distribution. As can be seen in FIG. 4, the shapes of the cutouts 20 and, hence, of the flaps 22, are long or short, curvilinear, oblong, rectangular, triangular, or circular.

These profiles are retained depending on the zone and on the available space in this zone.

The profiles on a given sheet can be different.

Each metallic sheet can undergo the different steps of the continuous process on the same production line. The gasket thus obtained and provided with at least one sheet 10 with at least one raised surface zone 24 obtained by the process of the invention is simple and perfectly reproducible once the tools have been adapted because there is no other external intervention that would cause variation of the different parameters.

More particularly, such a process is applicable in the case of metallic cylinder head gaskets, such as a single-sheet gasket and the intermediate sheet of a multi-sheet gasket.

According to a variant of the present invention, it is possible to provide, for example at the end of the flap 22, at least one rib at the same time as the extension.

This also makes it possible to obtain a raised surface zone 24 and to increase the number of ways in which to respond to problems that could turn out to be quite complicated, particularly in the case where the material of which the sheet 10 is made is only slightly malleable, such as stainless steel which constitutes the single-sheet gaskets.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A single-sheet gasket or multisheet gasket comprising:

a metallic sheet;

at least one raised surface zone that protrudes from a surface of said metallic sheet that is formed by at least one flap formed from a cutout in said metallic sheet, said at least one flap fixed to said metallic sheet at a first portion of said cutout and having an extension extending from a free end thereof that overlaps a second portion of said cutout opposite said first portion to provide said raised surface zone with an adjusted height h relative said surface.

2. The gasket as defined in claim 1, wherein said at least one flap has a profile that is a long or short curvilinear, oblong, rectangular, triangular or circular shape.

3. The gasket as defined in claim 1, further comprising a plurality of raised surface zones of the same shape and different heights.

4. The gasket as defined in claim 1, further comprising a plurality of raised surface zones of different shapes and the same height.

* * * * *